US008182362B2

(12) United States Patent
Kusumoto et al.

(10) Patent No.: US 8,182,362 B2
(45) Date of Patent: May 22, 2012

(54) GOLF CLUB HEAD

(75) Inventors: Harunobu Kusumoto, Saitama (JP); Takeshi Kasai, Saitama (JP); Atsushu Iijima, Saitama (JP); Hitoshi Tamura, Tokyo (JP)

(73) Assignee: Fu Sheng Industrial Co., Ltd., Taiwan (CN)

( * ) Notice: Subject to any disclaimer, the term of this patent is extended or adjusted under 35 U.S.C. 154(b) by 2217 days.

(21) Appl. No.: 10/319,604

(22) Filed: Dec. 16, 2002

(65) Prior Publication Data

US 2003/0114245 A1 Jun. 19, 2003

(30) Foreign Application Priority Data

Dec. 17, 2001 (JP) ..... P2001-382474
Oct. 21, 2002 (JP) ..... P2002-305235

(51) Int. Cl.
*A63B 53/04* (2006.01)

(52) U.S. Cl. ..... 473/324; 473/334; 473/342; 473/345; 473/349; 473/350

(58) Field of Classification Search ..... 420/108, 420/113, 584.1, 441; 148/327, 335; 428/687; 164/138; 473/324, 287, 290, 291, 349, 350, 473/334, 335, 336, 337, 338, 339, 345, 346, 473/342

See application file for complete search history.

(56) References Cited

U.S. PATENT DOCUMENTS

| | | | | | |
|---|---|---|---|---|---|
| 3,722,887 | A | * | 3/1973 | Cochran et al. | 473/242 |
| 3,859,055 | A | * | 1/1975 | Larsen | 428/687 |
| 4,692,305 | A | * | 9/1987 | Rangaswamy et al. | 420/436 |
| 5,207,427 | A | * | 5/1993 | Saeki | 473/343 |
| 5,676,606 | A | * | 10/1997 | Schaeffer et al. | 473/340 |
| 5,836,830 | A | * | 11/1998 | Onuki et al. | 473/349 |
| 5,913,735 | A | * | 6/1999 | Kenmi | 473/338 |
| 6,012,990 | A | * | 1/2000 | Nishizawa | 473/345 |
| 6,093,112 | A | * | 7/2000 | Peters et al. | 473/291 |
| 6,099,414 | A | * | 8/2000 | Kusano et al. | 473/342 |
| 6,102,812 | A | * | 8/2000 | Takeda | 473/291 |
| 6,117,023 | A | * | 9/2000 | Onuki et al. | 473/342 |

FOREIGN PATENT DOCUMENTS

| | | |
|---|---|---|
| JP | 07-216490 | 8/1995 |
| JP | 2526530 | 6/1996 |
| JP | 09-262326 | 10/1997 |
| JP | 10-094623 | 4/1998 |
| JP | 10-201887 | 8/1998 |
| JP | 2001-129134 | 5/2001 |

* cited by examiner

*Primary Examiner* — Sebastiano Passaniti
(74) *Attorney, Agent, or Firm* — McGinn Intellectual Property Law Group, PLLC

(57) ABSTRACT

A weight piece (14) containing 15 wt. % or greater of iron and tungsten, and having a specific gravity of 9 or larger, larger than a material of a head body (10) made of steel or pure iron, is joined to the head body (10) by welding.

26 Claims, 8 Drawing Sheets

FIG. 12

| | COMPOSITION (wt. %) | | | | SPECIFIC GRAVITY | CASTING EVALUATION | | | | | |
|---|---|---|---|---|---|---|---|---|---|---|---|
| ELEMENT | W | Ni | Fe | OTHERS | | CASTING SURFACE STATE | GAS POCKETS | FLOW OF MOLTEN METAL | JOINT STRENGTH | | COMPREHENSIVE EVALUATION |
| DENSITY | 19.3 | 8.9 | 7.9 | | | | | | | NUMBER OF TRIAL HITS | |
| TEST 1 | 80.00% | 9.00% | 10.00% | 1.00% | 15.26 | NO GOOD | NO GOOD | NO GOOD | NO GOOD | 100hits, CRACKED | × |
| TEST 2 | 70.00% | 14.00% | 15.00% | 1.00% | 13.83 | GOOD | GOOD | GOOD | GOOD | 3000hits | ○ |
| TEST 3 | 70.00% | 19.00% | 10.00% | 1.00% | 13.97 | NO GOOD | GOOD | NO GOOD | NO GOOD | 500hits, CRACKED | × |
| TEST 4 | 60.00% | 19.00% | 20.00% | 1.00% | 12.64 | GOOD | GOOD | GOOD | GOOD | 3000hits | ○ |
| TEST 5 | 50.00% | 19.00% | 30.00% | 1.00% | 11.55 | GOOD | GOOD | GOOD | GOOD | 3000hits | ○ |
| TEST 6 | 40.00% | 14.00% | 45.00% | 1.00% | 10.54 | GOOD | GOOD | GOOD | GOOD | 3000hits | ○ |
| TEST 7 | 30.00% | 49.00% | 20.00% | 1.00% | 10.28 | GOOD | GOOD | GOOD | GOOD | 3000hits | ○ |
| TEST 8 | 30.00% | 39.00% | 30.00% | 1.00% | 10.23 | GOOD | GOOD | GOOD | GOOD | 3000hits | ○ |
| TEST 9 | 30.00% | 30.00% | 39.00% | 1.00% | 10.17 | GOOD | GOOD | GOOD | GOOD | 3000hits | ○ |
| TEST 10 | 25.00% | 39.00% | 35.00% | 1.00% | 9.98 | GOOD | GOOD | GOOD | GOOD | 3000hits | ○ |
| TEST 11 | 25.00% | 34.00% | 40.00% | 1.00% | 9.94 | GOOD | GOOD | GOOD | GOOD | 3000hits | ○ |
| TEST 12 | 20.00% | 40.00% | 39.00% | 1.00% | 9.55 | GOOD | GOOD | GOOD | GOOD | 3000hits | ○ |
| TEST 13 | 20.00% | 19.00% | 60.00% | 1.00% | 9.16 | GOOD | GOOD | GOOD | GOOD | 3000hits | ○ |
| TEST 14 | 20.00% | 9.00% | 70.00% | 1.00% | 9.04 | GOOD | GOOD | GOOD | GOOD | 3000hits | ○ |
| TEST 15 | 15.00% | 65.00% | 19.00% | 1.00% | 9.42 | GOOD | GOOD | GOOD | GOOD | 3000hits | ○ |
| TEST 16 | 15.00% | 14.00% | 70.00% | 1.00% | 8.80 | GOOD | GOOD | GOOD | GOOD | 3000hits | × SPECIFIC GRAVITY IS TOO LOW |
| TEST 17 | 10.00% | 44.00% | 45.00% | 1.00% | 8.85 | GOOD | GOOD | GOOD | GOOD | 3000hits | × SPECIFIC GRAVITY IS TOO LOW |

GOLF CLUB HEAD

BACKGROUND OF THE INVENTION

The present invention relates to a sports tool using tungsten and a method of manufacturing the same. The invention maybe applied to for golf things, e.g., golf club heads, fishing gears, e.g., lure, reel, chum cage, and sinker, and parts of a bicycle. The golf club head is classified into a golf club head of a hollow metal shell type, also called a wood type golf club, a putter, and an iron golf club. For the reel, a bail holder may be enumerated.

Of those golf clubs, the putter and iron clubs, by convention, are made of a metallic material of an iron or titanium family. When two golf club heads of the same size are compared, one golf club head having a larger moment of inertia about the center of gravity than the other is broader in sweet area. Accordingly, even when the impact point is out of the sweet spot, the golf club head swung is stable, and a direction of a hit ball is stable. In this respect, the golf club head having the large moment of inertia is preferable. For this reason, it is desired that the golf club head is made of a material having a large specific gravity. Examples of metals each having a large specific gravity than iron or titanium are copper, lead and tungsten. Examples of things which are desirably made of materials each having a large specific gravity are a sinker, and a lure in the light of size reduction possibility. Those things may be applied to parts of a bicycle.

Copper and lead, however, are limited in their applications to sports goods since those are too soft. Tungsten has the largest specific gravity in the metals mentioned above. If tungsten can be used for the golf club head, the following advantages are gained: A moment of inertia of the golf club head is increased and the size of the golf club head is reduced for the same weight. The golf club head using tungsten is disclosed in Japanese Patent Application Laid-Open Publications (JP-A) Nos. 07-216490 and 09-262326. The former golf club head is manufactured by sintering, and the latter one, by sintering and forging.

A melting temperature of tungsten is high, 3370° C. To mold industrial goods made of tungsten, it is impossible to melt and forge the metal material. Accordingly, usually, metal powder is sinter molded as disclosed in the publications. The sinter molding has industrial problems, however. It is difficult to mold the product in a complicated shape. A sintering time is generally long. A sintering temperature is still high, 1500° C. A dedicated mold is needed. Cost of the molding die and cost to mold are not inexpensive. In carrying out the forging process following the sintering process, the problems on the sintering process exist, and further a step for the forging is needed, and much and troublesome labor is required. A molded product by the sintering process has a high hardness. It is difficult to work the molded product by machining and polishing, and hence the finishing work is difficult.

In order to, for example, stabilize the impact by the golf club, the position of the center of gravity of the club head has been adjusted. Club structures each with a weight part or a weight piece are disclosed in some patent publications.

Japanese Patent No. 2526530 discloses a golf club head in which a window hole is formed in a rear part of the head hollow part, and a weight having a larger specific gravity than the head body is caulked at the window hole.

Japanese Patent Unexamined Publication NO. 2001-129134 discloses a golf club head in which an opening is formed in a bottom part of a hollow shell head body made of maraging steel, a sole piece provided with a partially thick weight part made of stainless steel is welded at the opening.

Japanese Patent Unexamined Publication No. Hei.10-94623 discloses a golf club head in which the weight piece with a through hole is made of a tungsten sintered alloy of 10 or higher in specific gravity, and is held by passing a pin through the through hole and deforming the pin.

Japanese Patent Unexamined Publication No. Hei. 10-201887 discloses a golf club head in which a weight piece made of tungsten, for example, is secured with a cladding welding part.

In JP-A-2001-129134, since iron family metals (steels) are jointed together by welding so as to secure an easy welding, a specific gravity of the weight part is a little different from that of other parts of the club head. As a result, the effect by the weigh part is small. When the weight is fastened by caulking, the caulked part is loosened with its use, and will generate abnormal noisy sound when the ball is hit with the club head. In the case of JP-A-Hei. 10-94623, the weight piece has a large specific gravity. Accordingly, the weight piece efficiently exhibits its weight function. This structure will suffer from the loosening as in JP-B-2526530, however. Further, the pin is exposed to outside, making the outward appearance unattractive. In JP-A-Hei. 10-201887, when the weight piece is made of (pure) tungsten. The cladding welding member freely varies its shape in its welding state. Accordingly, the weight piece is secured in a state that it is held down from above. It is difficult to melt the weight piece itself, and no technical disclosure of the welding condition in the sense of melting the weight piece itself is presented in the patent publication. What is disclosed is only the fact that the cladding welding part is used as a brazing filler metal. The joint strength by the brazing is weaker than the strength of the welding. Accordingly, the brazing is unsatisfactory in securing a reliable durability of the golf club head.

SUMMARY OF THE INVENTION

Accordingly, object of the invention is to provide a sports tool which may be mass-produced even if its profile is complex, while making the best use of the high specific gravity of tungsten. Another object of the invention is to provide a sports tool of low cost. Yet another object of the invention is to provide a sports tool in which the finishing work is easy when the work is required.

Another an object of the present invention is to provide a golf club head which uses a tungsten alloy of high specific gravity for the weight piece, and provides satisfactorily reliable durability of the joint by the welding.

In order to solve the aforesaid object, the invention is characterized by having the following arrangement.

(1) A sports tool comprising a tungsten alloy part which is formed by casting process, contains 15 to 70 wt. % of tungsten, 15 to 17 wt. % of iron, and 9 to 65 wt. % of nickel, and has a specific gravity of 9 or larger.

(2) The sport tool according to (1), wherein the tungsten alloy part formed in a manner that a material is cast is further forged.

(3) A method of manufacturing a sports tool comprising a step of casting a tungsten alloy product which contains at least 15 to 70 wt. % of tungsten, 15 to 17 wt. % of iron, and 9 to 65 wt. % of nickel, and has a specific gravity of 9 or larger.

(4) The method according to (3) further comprising a step of forging the tungsten alloy product.

(5) A golf club head comprising a head body is formed of the tungsten alloy part according to (1) or (2).

(6) The golf club head according to (5), wherein the head body is partially formed of the tungsten alloy according to (1) or (2).

(7) The golf club head according to (6), wherein the head body includes a face plate formed of different material from the tungsten alloy according to (1) or (2).

(8) A golf club head comprising:
a head body; and
a weight piece joined to the head body, which is formed of the tungsten alloy according to (1) or (2).

(9) A golf club head comprising:
a head body; and
a weight piece containing 15 wt. % or greater of iron and tungsten, and having a specific gravity of 9 or greater, larger than a material of the head body made of steel or pure iron, the weight being joined to the head body by welding.

(10) The golf club head according to (9), wherein the weight piece is casting molded.

(11) The golf club head according to (9), wherein the weight piece is exposed to outside, and a peripheral part of the weight piece is thinner than a central part thereof.

In the present disclosure relates to the subject matter contained in Japanese patent application Nos. 2001-382474 (filed on Dec. 17, 2001) and 2002-305235 (filed on Oct. 21, 2002), which are expressly incorporated herein by reference in their entireties.

BRIEF DESCRIPTION OF THE DRAWINGS

FIG. 12 shows the results of various tests which were conducted for casting the golf club head.

DETAILED DESCRIPTION OF PREFERRED EMBODIMENTS

The preferred embodiment of the present invention will be described in detail with reference to the accompanying drawings.

First Embodiment

Figure 1:
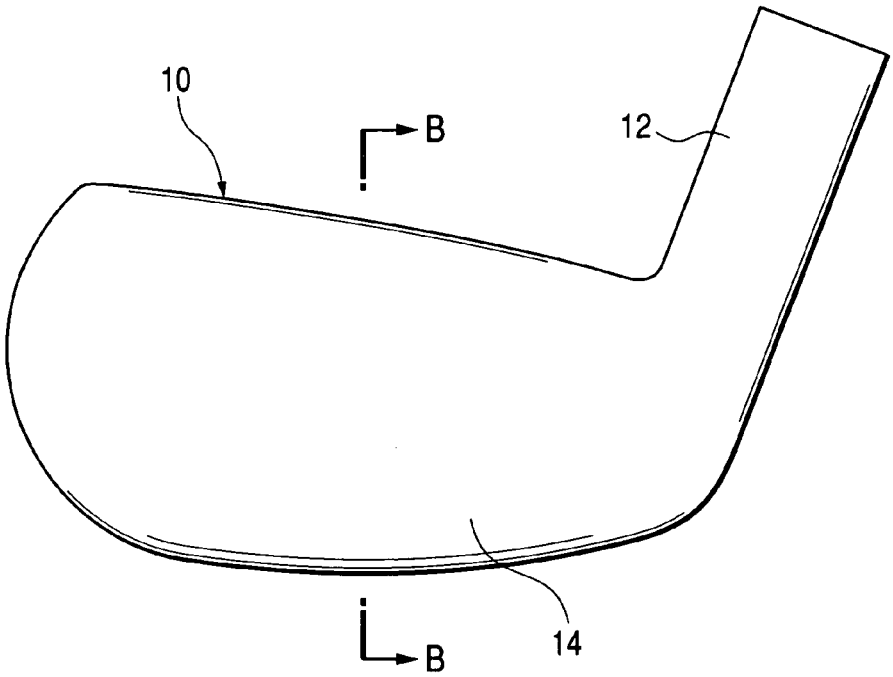
FIG. 1 is a front view showing an iron golf club which is a first embodiment of the invention.
Figure 2:
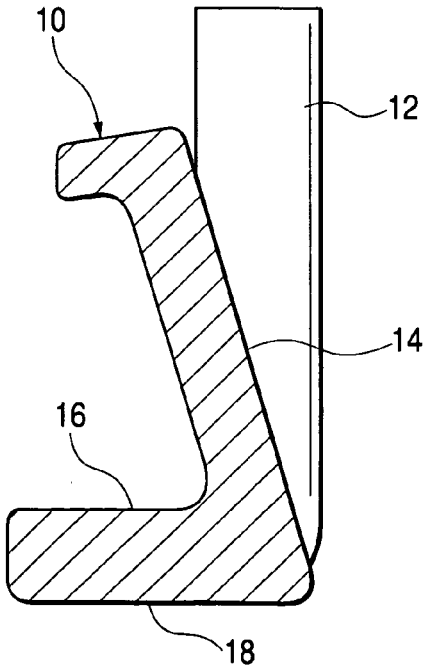
FIG. 2 is a transverse sectional view taken on line B-B in FIG. 1.

FIG. 1 is a front view showing a head 10 of an iron golf club in which the head is integral with a hosel portion 12. FIG. 2 is a transverse sectional view taken on line B-B in FIG. 1. A cavity (depressed portion) 16 is formed in the rear side of a face part 14 of the head 10. A sole portion 18 is located in a lower part of the cavity. In the invention, a head with a hosel is formed with a tungsten alloy part which is formed by casting process, contains at least 15 to 70 wt. % of tungsten, 15 to 70 wt. % of iron, and 9 to 65 wt. % of nickel, and has a specific gravity of 9 or larger.

FIG. 12 shows the results of various tests which were conducted for casting the golf club head and a weight piece of the golf club head. In the tests, a component ratio of nickel Ni, iron Fe and tungsten was varied.

The results of tests were comprehensively evaluated. The evaluation was made on four points: the flow of molten metal; cast surface condition, such as dappled patterns other than gas pockets, inverted blisters and twists; formation of gas pockets; and joint strength by trial hitting. The joint strength was measured with employing as an example a golf club heads described in a third embodiment in which a weight piece 14 was welded to a head body 10 made of JIS SUS630 (described later). Each golf club head contains tungsten W, iron Fe, and nickel Ni as major compositions, and additionally 1 wt. % of tin Sn and copper Cu in sum as others. In the invention, as to others, it is allowed that one or both of the additives are not present, one or both of the additives and a small amount of another additive as well are present, or the small amount of the another additive is present without both the additives. Iron is added for mainly improving the flow of molten metal, and lowers the melting temperature. Nickel contributes mainly to the lowering of the melting temperature.

In the comprehensive evaluation, the tested club heads that are evaluated to be no good (X) are the club heads of the tests 1 and 3 except those of the tests 16 and 17 in which the specific gravity is smaller than 9. In those tested club heads, the amount of iron is small, 10%, and crack was found at the head ends. It is estimated that since the flow of molten metal was bad, the cast surface condition was unsatisfactory. In the club head of test 1, gas pockets also were observed, and the club head was judged to be defective. When comparing the club head of test 2 with that of test 3, in the club head of test 2, the nickel amount is small, 14%, but the iron amount is large, 15%. Accordingly, it is estimated that the flow of molten metal and the cast surface condition as well were improved, and no gas pockets were formed. In all of the club heads of other tests, the amount of iron was 15 wt. % or higher, and the flow of molten metal was good, and other evaluation items were good.

As seen from the testing results, it is necessary that the amount of iron is within a range from 15 wt. % to 70 wt. %. To secure that a specific gravity of the club head is 9 or larger, the amount of tungsten must be 15 wt. % or larger. When the amount of tungsten is selected to be 70 wt. % or larger, since the amounts of remaining compositions are too small, the resultant club heads are evaluated to be no good (see test 1). As for nickel, when the amount of nickel is within a range from 9% to 65%, the comprehensive evaluation was good (○). The sports tools such as club head thus formed by casting process, unlike the sintered product, allows machining process or the like to be used for finishing. To avoid use of the finishing work as possible, it is preferable to use a precision casting method, e.g., a so-called lost-wax method.

Second Embodiment

Figure 3:
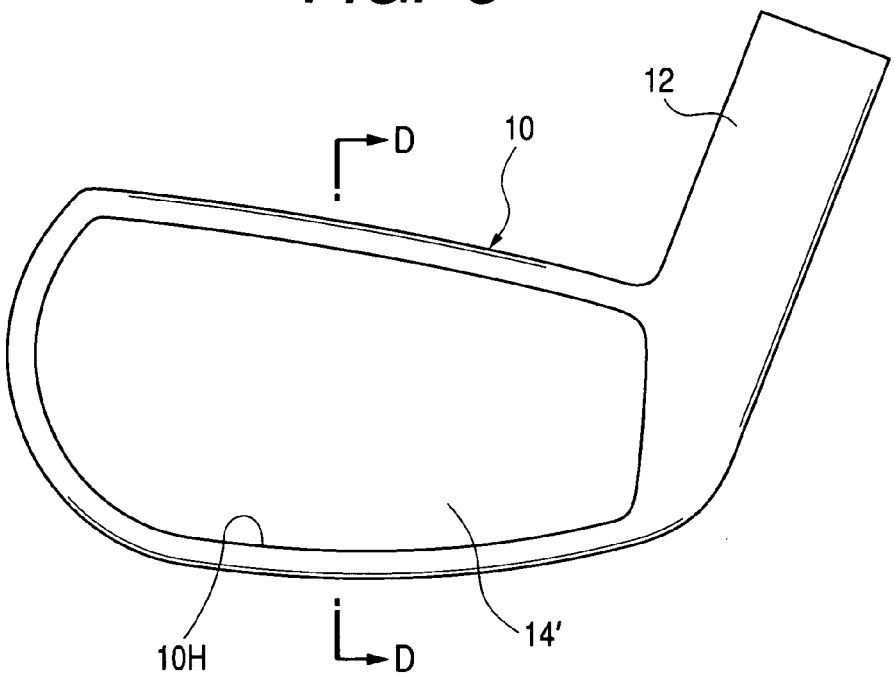
FIG. 3 is a front view showing an iron golf club which is a second embodiment of the invention.
Figure 4:
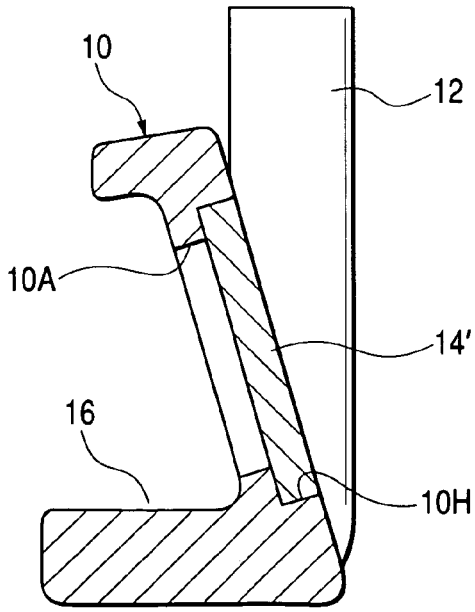
FIG. 4 is a transverse sectional view taken on line D-D in FIG. 3.

FIGS. 3 and 4 cooperate to show a second embodiment of the invention. In a head 10 of this embodiment, a head body except a face plate 14' on which a face part is to be formed is formed with a tungsten alloy part formed according to the invention. An area of the head body, which is located on the rear side of the face plate, has a through hole 10A formed therein except the peripheral edge part. The iron golf club head 10 thus formed has a large moment of inertia about the center of gravity since tungsten contained therein has a high specific gravity, and is a convenient golf club head as already stated. For the face plate 14', not only the tungsten alloy part of the invention, but also another suitable member having high restitution characteristic may be used. In this respect, design freedom is increased in head design.

To integral the face plate 14' into the head body, the outer peripheral edge 10H of the head body, which receives the face plate 14', is caulked and welding process is carried out. For example, when the face plate 14' is formed of a titanium alloy, the caulking is preferably used, and when it is formed of maraging steel, the welding is preferably used. While the whole product is formed of a tungsten alloy in the embodiment mentioned above, another member may be combined with a part of the product. It is suggestible that rust-preventive process is applied to the tungsten alloy part of the invention, viz., the tungsten alloy part is covered with a corrosion-proof protecting film, e.g., plated film.

Third Embodiment

Figure 5:
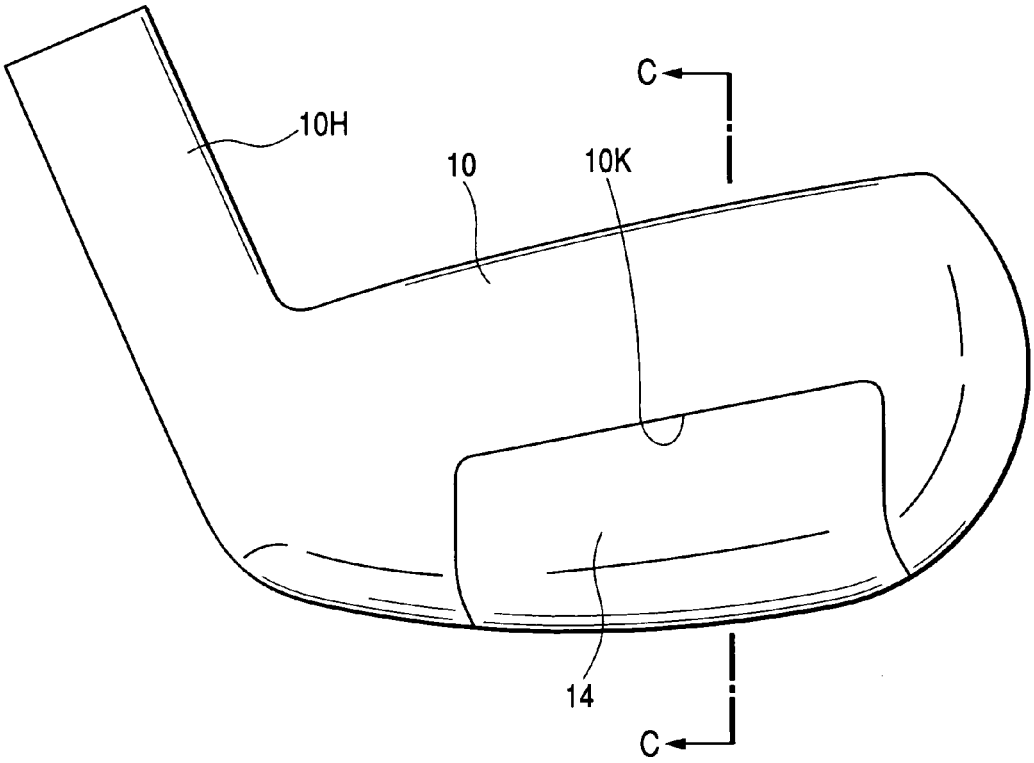
FIG. 5 is a rear view showing a golf club head constructed according to the invention.
Figure 6:
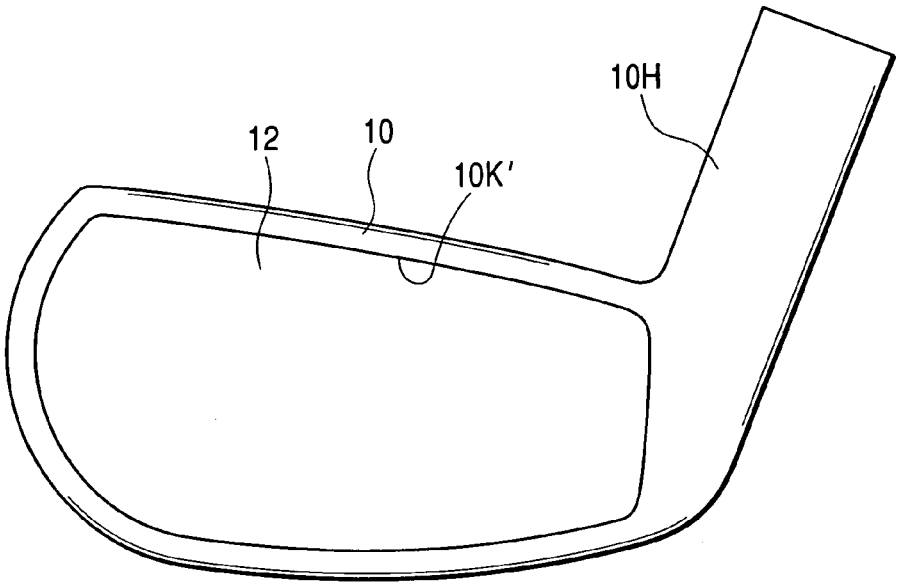
FIG. 6 is a front view showing the golf club head.
Figure 7:
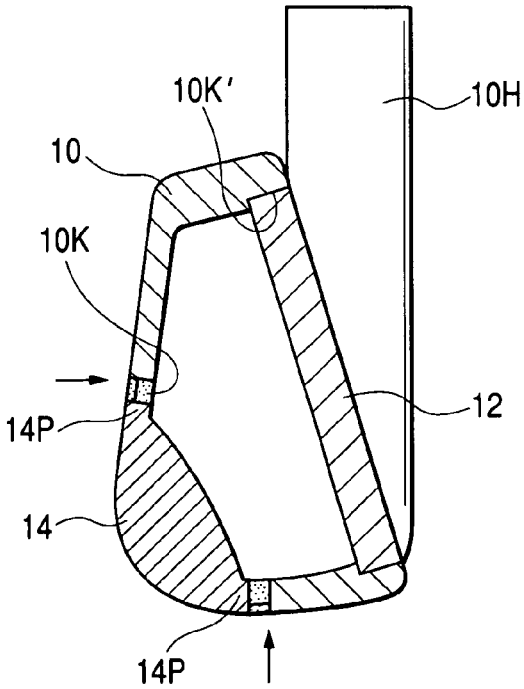
FIG. 7 is a transverse sectional view taken on line C-C in FIG. 5.

FIG. 5 is a rear view showing a golf club head constructed according to a third embodiment of the invention. FIG. 6 is a front view showing the golf club head. FIG. 7 is a transverse sectional view taken on line C-C in FIG. 5. The golf club head is constructed with three component parts 10, 12 and 14. In the embodiment, the golf club head has a hollow interior, but it may not be hollowed. The head body 10 is a cast product of a stainless steel of SUS630, for example. It maybe a product other than the cast product, if it is made of steel or pure iron. The golf club head is formed integral with a hosel portion 10H. An opening 10K is formed ranging from a lower part of a back portion located near a sole portion to the sole portion. Another opening 10K' is formed also in a ball hitting surface (face portion) . The head body may be of the type in which the hosel portion is formed separately from the head body.

A metal face plate 12, which is made of a material different from that of the head body 10, such as a titanium alloy or a maraging steel, is jointed to the opening 10K' by joining means, for example, welding or caulking. If required, the face plate and the head body may be integrally formed by casting process, without forming the opening 10K'.

A weight piece 14 is joined to the opening 10K by welding.

The weight piece is made of a tungsten alloy having a larger specific gravity than a molding material of the head body 10. The illustrations of the openings 10K and 10K' in FIGS. 5 and 6 do not indicate that lines of those openings are inevitably visible after the molding process, but indicate that the openings are located originally. To effectively apply the weight to the club head, the weight piece la is made preferably of a tungsten alloy of which the specific gravity is 9 or larger, preferably 10 or larger.

Figure 8:
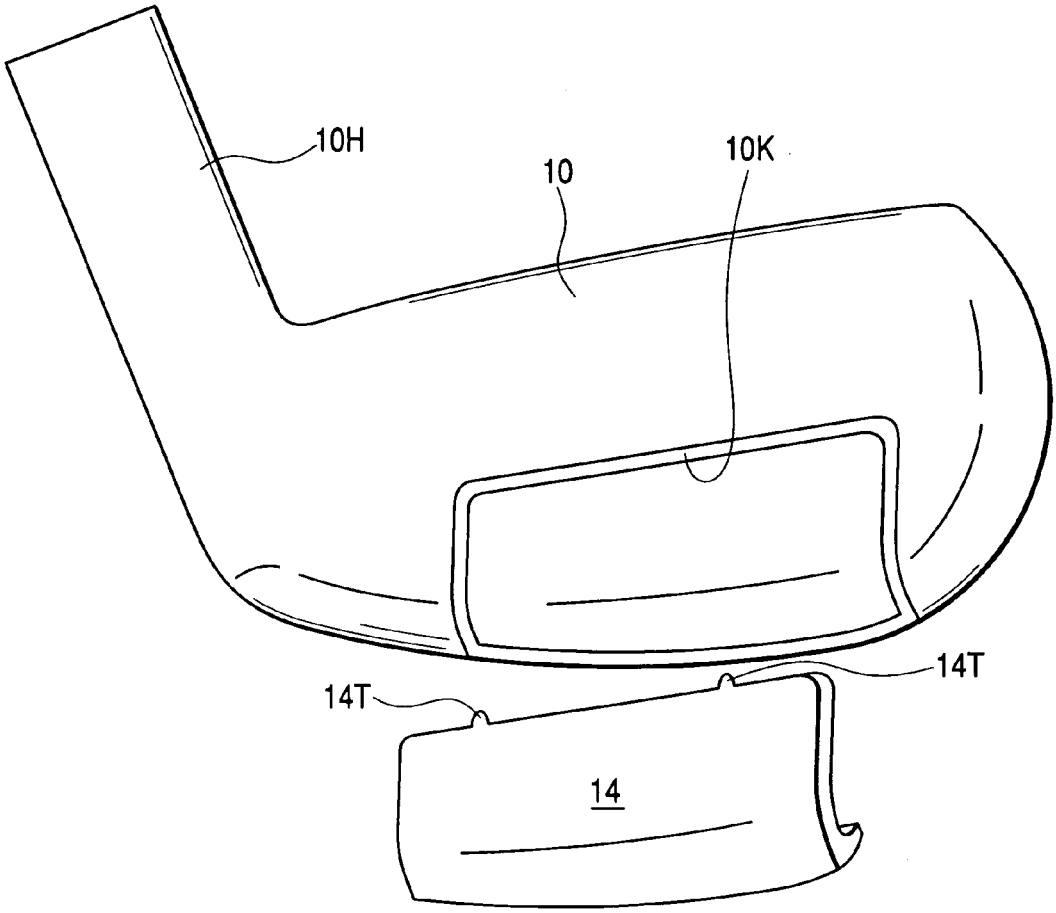
FIG. 8 is an exploded view showing the golf club head before a welding process is carried out.

Referring to FIG. 8 showing the club head before a welding process is carried out, protrusions 14T are provided at appropriate positions on the peripheral edge of the weight piece 14 in order to secure an ease of the work of welding the weight piece 14 to the head body. A peripheral edge of the opening 10K is tapered. The protrusions 14T may be put on the tapered part of the opening peripheral edge. The welding maybe carried out in a state that the protrusions are fixed to the opening peripheral edge. Since there is the necessity of filling a gap between the protrusions, it is preferable to carry out the welding while filling the gap by use of the so-called TIG welding, which uses a welding rod.

The welding rod is made of stainless steel, for example, but may be made of the same material as of the weight piece. The weight piece 14 is located close to the toe of the opening 10K and in this state, the welding may be carried out. The back portion and the sole portion of the head body 10 are thinner than the top potion. The peripheral edge 14P of the weight piece 14 to be welded is designed to be also thinner than a central part of the weight piece to correspond to the back portion and the sole portion. In this way, the portions to be molten by the welding are easy to be molten. The weight piece 14 may entirely be made of a uniform composition. If the content of iron Fe by percentage (wt. %) in the portions to be welded by welding, e.g., peripheral edge 14P, is larger than that in other portions, the durability of the welded portions and the outward appearance are improved, and the welding work is easy.

The weight piece 14 applies a weight to the golf club head, and forms a part of an outer shell of the golf club head, and is exposed to outside. When nickel Ni is added to the material of the weight piece 14 containing iron, a hardness and tensile strength of the weight piece are improve, and further sticking strength and corrosion resistance are improved. The material thus prepared is preferable for the material of the outer shell of the golf club head which is impacted with a ball or used in the open air. The weight piece 14 may be installed while being concealed. Further, the weight member 14 is located at a lower part of the head. With this feature, the weight piece contributes to the lowering of the center of gravity.

Since the weight piece is exposed as already mentioned, the inertia moment of the weight piece is larger than the weight piece installed inside. This feature contributes to the stabilization of hitting.

As shown in FIG. 12 and mentioned above, the results of the tests 16 and 17 show that the specific gravity is too low. Those golf club heads could not achieve the object. The golf club head of the test 1 was no good since the cast surface was bad, gas pockets were formed, and the welding part was cracked in the trial hitting. The golf club head of the test 3 was no good since the cast surface was bad and the welding part was cracked in the trial hitting. The golf club heads of the remaining tests were good since no problem arose in the joint strength up to 3000 hits.

The tests showed that the comprehensive evaluation was good (○). when a component ratio of iron was within a range of 15 wt. % or greater. In the tests, it was confirmed that The upper limit of the component ratio of iron was 70 wt. %. A component ratio of nickel Ni was within a range of 8 wt. % to 65 wt. %. As already described, nickel Ni is a component for improvement of a hardness and tensile strength of the weight piece are improve, and further sticking strength and corrosion resistance. Ease of the welding depends on a component of iron.

Fourth Embodiment

Figure 9:
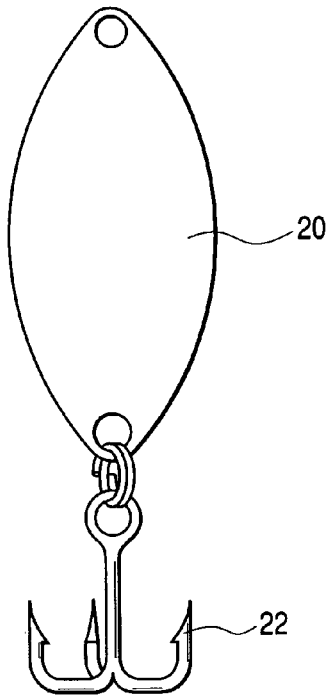
FIG. 9 is a front view showing a lure which is a third embodiment of the invention.

FIG. 9 shows a lure used for fishing to which a tungsten alloy of the invention is applied. In this instance, a lure body 20, not a fishhook 22, is formed of the tungsten alloy of the invention. Accordingly, the lure body 20 may be formed to be small in size.

Figure 10:
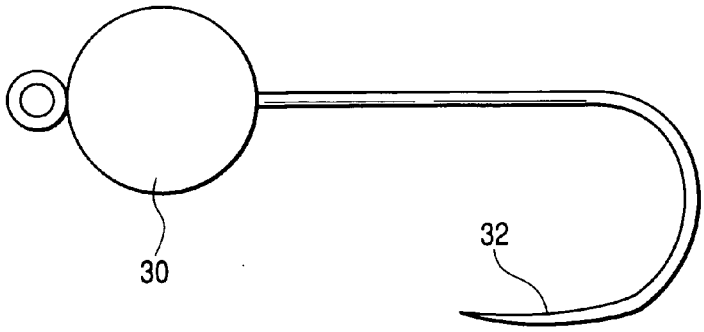
FIG. 10 is a front view showing a fishhook which is a fourth embodiment of the invention.

FIG. 10 shows an application of the invention in which the tungsten alloy of the invention is applied to a sinker 30 attached to the base of a fishhook 32 for fishing. Also in this case, the sinker size may be reduced.

Figure 11:
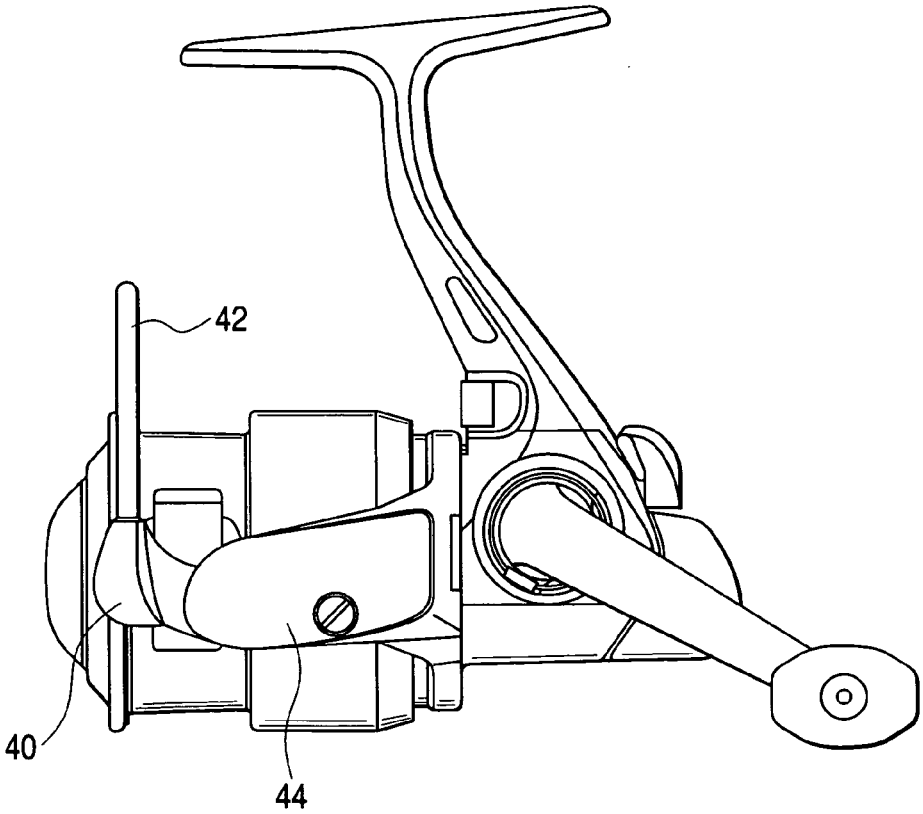
FIG. 11 is a front view showing a spinning reel which is a fifth embodiment of the invention.

FIG. 11 shows a case where the invention is applied to a spinning reel. The tungsten alloy of the invention is used for a bail holder 40, which is installed to an arm part 44 of a rotor, and holds a bail 42. This is used for an adjusting member for securing a rotation balance of the rotor. In a case where a weight is actively used for the purpose of gaining the rotation balance, the weight size may be advantageously reduced.

As seen from the foregoing description, the invention successfully provides a sports tool which maybe mass-produced even if its profile is complex, while making the best use of the high specific gravity of tungsten.

Further, the invention succeeds in providing a golf club head which uses a tungsten alloy having a high specific gravity for a weight piece, has a welding joint part of a highly reliable durability, and has an attractive outward appearance.

What is claimed is:

1. A golf club head comprising:

a head body comprising a tungsten alloy which is formed by a casting process, said tungsten alloy comprising 15 wt. % to 70 wt. % of tungsten, 15 wt. % to 17 wt. % of iron, and 9 wt. % to 65 wt. % of nickel, and having a specific gravity of at least 9.

2. The golf club head according to claim 1, wherein the head body is partially formed of the tungsten alloy.

3. The golf club head according to claim 2, wherein the head body comprises a face plate formed of different material from the tungsten alloy.

4. The golf club head according to claim 1, wherein said tungsten alloy part which is formed by casting process comprises a cast and a forged tungsten alloy part.

5. A golf club head comprising:

a head body; and a weight piece joined to the head body, comprising a tungsten alloy comprising 15 wt. % to 70 wt. % of tungsten, 15 wt. % to 17 wt. % of iron and 9 wt. % to 65 wt. % of nickel, and having a specific gravity of at least 9.

6. The golf club head according to claim 5, wherein said tungsten alloy part which is formed by casting process comprises a cast and a forged tungsten alloy part.

7. The golf club according to claim 5, wherein said head body comprises stainless steel.

8. The golf club according to claim 5, further comprising:

a face plate disposed on a side of said head body which is opposite to said weight piece.

9. The golf club according to claim 8, wherein said face plate is formed on said head body by at least one of welding and caulking.

10. The golf club according to claim 8, wherein said face plate is integrally formed with said head body by a casting process.

11. The golf club according to claim 8, wherein said face plate comprises at least one of titanium and maraging steel.

12. The golf club according to claim 5, wherein the specific gravity of said weight piece is larger than a specific gravity of said head body.

13. The golf club according to claim 5, wherein said weight piece is joined to said head body by at least one of welding and caulking.

14. The golf club according to claim 5, wherein said weight piece comprises a casting molded weight piece.

15. A golf club head comprising:

a head body comprising at least one of steel and pure iron; and a weight piece comprising a tungsten alloy comprising at least 15 wt. % of iron and at least 15 wt. % of tungsten, and having a specific gravity of at least 9 which is greater than a material of the head body, the weight being joined to the head body by welding.

16. The golf club head according to claim 15, wherein the weight piece comprises a casting molded weight piece.

17. The golf club head according to claim 15, wherein the weight piece is exposed to outside, and a peripheral part of the weight piece is thinner than a central part thereof.

18. The golf club head according to claim 15, further comprising protrusions disposed on a peripheral edge of said weight piece.

19. The golf club head according to claim 15, wherein said weight piece forms a part of an outer shell of the golf club head and is exposed to the outside of the golf club head.

20. A golf club head comprising:

a head body comprising a tungsten alloy comprising 15 wt. % to 70 wt. % of tungsten, 15 wt. % to 17 wt. % of iron and 9 wt. % to 65 wt. % of nickel.

21. The golf club head according to claim 20, wherein said head body is partially formed of said tungsten alloy.

22. The golf club head according to claim 21, further comprising:

a face plate disposed on said head body, wherein said face plate comprises a material different from said tungsten alloy.

23. The golf club head according to claim 22, wherein said face plate comprises at least one material selected from the group consisting of titanium alloy and maraging steel.

24. The golf club according to claim 22, wherein said face plate is formed on a peripheral edge of said head body by at least one of welding and caulking.

25. The golf club head according to claim 20, wherein said tungsten alloy comprises a specific gravity of at least 9.

26. The golf club according to claim 20, further comprising:

a corrosion-proof protecting film disposed over said head body.

* * * * *